US009150032B2

(12) United States Patent
Roof et al.

(10) Patent No.: US 9,150,032 B2
(45) Date of Patent: Oct. 6, 2015

(54) METHODS, APPARATUS, AND SYSTEMS FOR CONTROLLING AN INITIAL LINE WIDTH OF RADIATION CURABLE GEL INK

(75) Inventors: Bryan J. Roof, Newark, NY (US); Anthony S. Condello, Webster, NY (US); Edward B. Caruthers, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 939 days.

(21) Appl. No.: 13/222,993

(22) Filed: Aug. 31, 2011

(65) Prior Publication Data

US 2013/0052332 A1 Feb. 28, 2013

(51) Int. Cl.

| | |
|---|---|
| ***B41J 2/01*** | (2006.01) |
| ***B05D 3/06*** | (2006.01) |
| ***B41J 11/00*** | (2006.01) |
| ***B41F 23/04*** | (2006.01) |
| ***B41M 7/00*** | (2006.01) |

(52) U.S. Cl.

CPC ..... *B41J 11/002* (2013.01); *B41F 23/0406* (2013.01); *B41J 11/0015* (2013.01); *B41M 7/0081* (2013.01)

(58) Field of Classification Search

CPC .. B41J 11/0015; B41J 11/002; B41F 23/0406
USPC ..... 347/102, 88; 427/553, 374.1, 595, 558, 427/8

See application file for complete search history.

(56) References Cited

U.S. PATENT DOCUMENTS

| | | | | |
|---|---|---|---|---|
| 8,262,210 | B2 * | 9/2012 | Chretien et al. | 347/99 |
| 2005/0190248 | A1 * | 9/2005 | Konno et al. | 347/102 |
| 2010/0101717 | A1 * | 4/2010 | Roof | 156/250 |
| 2012/0320117 | A1 * | 12/2012 | Roof et al. | 347/9 |

OTHER PUBLICATIONS

JuJo Chemical. (UV Ink—UV Curable Ink) Jujo Technical Information Jul. 2008 retreived from http://www.jujo-chemical.co.jp/e/gijutsu_joho/gj_files/ippan_ink/uv_ink.html.*

Bryan J. Roof et al.; Methods for Radition Curable Gel Ink Leveling and Direct-To-Substrate Digital Radiation Curable Gel Ink Printing, Apparatus and Systems Having Pressure Member With Hydrophobic Surface; U.S. Appl. No. 13/179,063, filed Jul. 8, 2011.

Bryan J. Roof et al.; Methods for UV Gel Ink Leveling and Direct-To-Substrate Digital Radiation Curable Gel Ink Printing, Apparatus and Systems Having Leveling Member With a Metal Oxide Surface; U.S. Appl. No. 13/173,492, filed Jun. 30, 2011.

* cited by examiner

*Primary Examiner* — Cachet Sellman

(74) *Attorney, Agent, or Firm* — Ronald E. Prass, Jr.; Prass LLP

(57) ABSTRACT

A radiation curable ink initial line width control system includes a print head that deposits radiation curable ink to form as-deposited ink lines on a substrate. A substrate heating system heats the substrate to heat the ink and spread the ink to increase a line width of the ink. The line width of the ink is increased before the ink is contact-leveled at a contact-leveling nip. The substrate is heated to a temperature that minimizes or avoids showthrough and/or coalescence in a printed image.

8 Claims, 4 Drawing Sheets

METHODS, APPARATUS, AND SYSTEMS FOR CONTROLLING AN INITIAL LINE WIDTH OF RADIATION CURABLE GEL INK

RELATED APPLICATIONS

This disclosure relates to METHODS FOR RADITION CURABLE GEL INK LEVELING AND DIRECT-TO-SUBSTRATE DIGITAL RADIATION CURABLE GEL INK PRINTING, APPARATUS AND SYSTEMS HAVING PRESSURE MEMBER WITH HYDROPHOBIC SURFACE (U.S. patent application Ser. No. 13/179,063) and METHODS FOR UV GEL INK LEVELING AND DIRECT-TO-SUBSTRATE DIGITAL RADIATION CURABLE GEL INK PRINTING, APPARATUS AND SYSTEMS HAVING LEVELING MEMBER WITH A METAL OXIDE SURFACE (U.S. patent application Ser. No. 13/173,492), the disclosures of which are incorporated herein by reference in their entirety.

FIELD OF DISCLOSURE

The disclosure relates to methods, apparatus, and systems for spreading radiation curable gel ink. In particular, the disclosure relates to methods, apparatus, and systems for controlling an amount of spreading of as-deposited radiation curable gel ink before the ink is contacted at a leveling nip.

BACKGROUND

Radiation curable gel inks, e.g., ultraviolet ("UV") curable gel inks, tend to form drops having less mobility than those formed by conventional inks when deposited directly onto a substrate. When radiation curable gel inks are jetted, for example, from a print head to be deposited directly onto a substrate to form an image, the ink drops are liquid. When the drops contact the substrate, they are quickly quenched to a gel state, and therefore have limited mobility.

Conventional inks tend to form mobile liquid drops upon contact with a substrate. To prevent coalescence of the mobile liquid ink drops during printing, substrates are typically coated and/or treated. For example, a paper substrate for use with conventional inks may be coated with materials that increase adhesion characteristics and increase surface energy, or otherwise affect chemical interaction between the paper substrate and inks. Such coatings or treatments require special operations to apply to the media, and additional cost is associated with their use in printing operations. A printing process using both digital presses and conventional presses may require different media supplies suitable for each press.

Radiation curable gel inks are advantageous for printing operations at least because they exhibit superior drop positioning on a variety of substrate types, regardless of how the substrates are treated. It is cost advantageous, for example, to run the same media or substrate type across multiple printing apparatuses without being required to use a particular substrate type, for example, specially coated stock.

SUMMARY

Radiation curable gel ink print heads typically leave a noticeable signature of the printing process. As ink is deposited onto media or a substrate to form, for example, an ink line, the deposited ink line(s) may a center that is thicker than outer edges of the ink line. For example, UV gel ink images may suffer from print artifacts such as a corduroy appearance attributed to hills and valleys caused by inconsistent ink drop line thicknesses and/or objectionable pile heights. Relying on a flood coat to achieve jetted gel ink line uniformity, and/or address varying line thickness and obviate objectionable print artifacts, can be costly and lead to a high gloss level that may be undesirable for some print jobs.

UV gel ink processes may benefit from methods, apparatus, and systems that cost-efficiently and effectively address objectionable pile heights and/or inconsistent ink line thicknesses by spreading the gel ink after the ink is jetted directly onto a substrate without degrading the printed image by, for example, offsetting gel ink onto the contact member, e.g., a leveling roll.

Contact-leveling the ink can flatten the ink to an extent to reduce pile and avoid objectionable image artifacts. A wider an initial width of a line of as-deposited ink accommodates effective contact-leveling of ink to form a printed image without offset of the ink onto contact-leveling components. To achieve a maximum line width while minimizing showthrough and/or coalescence of adjacent ink drops and/or lines, the media or substrate on which the ink is deposited may be heated to spread the ink before the ink is contacted at a contact-leveling nip of a radiation curable ink printing system.

In an embodiment, a radiation curable gel ink spreading method may include heating radiation curable gel ink after the ink is deposited on a substrate and before contact-leveling the ink at a leveling nip. Methods may include depositing the radiation curable ink onto the substrate to form an as-deposited ink line, wherein the heating heats the ink and spreads the as-deposited ink line to increase a width of the line.

In an embodiment, methods may include irradiating deposited and spread ink to partially cure the ink before contacting the ink at a contact-leveling nip. Methods may include contacting the radiation curable gel ink on a substrate with a contact member at a leveling nip, the leveling nip being formed by the contact member and a pressure member. The heating may include heating the substrate to a predetermined temperature. The predetermined temperature may be stored in a memory module, for example.

Methods may include determining whether a substrate file corresponding to the substrate type on which radiation curable gel ink is to be deposited is stored in a memory module, the substrate file being associated with a substrate type, and including the predetermined temperature that corresponds to the substrate type. If the substrate file is stored in a memory module, the predetermined temperature corresponding to the substrate type may be input to a controller, the controller being in communication with a substrate heating system and being configured to heat the substrate to the predetermined temperature.

In an embodiment, a substrate file may include a look-up table configured for determining an amount radiation required for each color of the ink at the predetermined temperature to partially cure the ink. Methods may include inputting the amount of radiation required to partially cure the ink to a controller, the controller being in communication with a radiation source; and irradiating the ink to partially cure the ink, the irradiating being based on the determined amount of radiation input to the controller.

If the substrate file is not stored in the memory module, methods may include determining a temperature to which to heat the substrate for increasing an initial line width of as-deposited ink before contact leveling the ink at a contact-leveling nip. For example, methods may include inputting a media or substrate type into a radiation curable ink initial line width control system; and inputting a substrate thickness. Methods may include determining whether the substrate is non-porous. If the substrate is non-porous, methods may include setting a substrate test temperature to a highest temperature known to be acceptable for the input substrate type having the input thickness. An acceptable temperature to which to heat the substrate may be a temperature at which coalescence of ink drops forming an ink line is minimized or avoided after spreading of the ink of the ink line, and increasing an initial line width.

In an embodiment, methods may include printing a test pattern, such as a coalescence test pattern. The test pattern may be observed for determining whether coalescence is acceptable. If coalescence is acceptable, the substrate test temperature may be stored as a predetermined temperature in a substrate file on a memory module, for example.

In an embodiment, if the substrate file is not stored in the memory module, methods may include inputting a substrate type and inputting a substrate thickness into a radiation curable ink initial line width control system. Methods may include determining whether a substrate is porous. If the substrate is porous, methods may include determining whether the substrate is coated.

If the substrate is porous and uncoated, methods may include setting a substrate temperature at about or less than ambient temperature, and printing a test pattern. Methods may include determining whether showthrough of the test pattern is acceptable. If showthrough is acceptable, the set temperature may be stored as a predetermined temperature in a substrate file of a particular type of substrate. If showthrough is not acceptable, methods may include decreasing the set substrate temperature by a predetermined amount, and running another test pattern. The process may be repeated until an acceptable temperature is found.

In an embodiment, if the substrate file is not stored in the memory module, methods may include inputting a substrate type and inputting a substrate thickness. Methods may include determining whether the substrate is porous, and determining whether the substrate is coated. If the substrate is porous and coated, methods may include setting a substrate temperature to a predetermined test temperature.

At the predetermined test temperature, a coalescence test pattern may be printed. Methods may include determining whether a coalescence of the test pattern is acceptable. If the coalescence is acceptable, methods may include printing a showthrough test pattern; and determining whether the showthrough test pattern is acceptable. If the showthrough is acceptable, the set test temperature may be stored as the predetermined temperature in a substrate file corresponding to the type of the substrate. If showthrough is not acceptable, methods may include decreasing the set test temperature by a predetermined amount, and printing a showthrough test pattern based on the decreased set test temperature.

In an embodiment, apparatus may include a radiation curable gel ink initial line width control apparatus including a print head, the print head being configured to deposit radiation curable gel ink onto a substrate to form an as-deposited ink line. Apparatus may include a substrate heating system, the substrate heating system being configured to heat the substrate, whereby heat is transferred to the as-deposited ink line to spread the as-deposited ink line for controlling an initial line width of the ink line. Apparatus may include a radiation source for curing the ink. For example, a radiation source may be arranged to irradiate the ink to partially cure the ink for effective leveling and/or gloss control at a contact-leveling nip without offsetting ink onto on or more components of the leveling nip.

In an embodiment, apparatus may include a contact-leveling nip, the contact leveling nip being defined by a contact member and a pressure member, wherein the substrate is configured for translation through the nip after being heated by the heating system, whereby the heated and spread ink line is contact-leveled at the nip. In another embodiment, apparatus may include a controller, the controller being in communication with a memory module and the substrate heating system, the controller being configured to adjust a temperature of the substrate by modifying an amount of heat applied to the substrate.

In an embodiment, apparatus may include at least one memory module, the at least one memory module being in communication with a substrate heating system controller, the controller being configured to apply an amount of heat to the substrate to heat the substrate to a predetermined temperature, the predetermined temperature being stored in the memory module. In another embodiment, apparatus may include at least one memory module, the at least one memory module being in communication with a radiation source controller, the controller being configured to apply a predetermined amount of radiation to the ink on the substrate to partially cure the ink, the predetermined amount of radiation being stored in the memory module.

In an embodiment, radiation curable gel ink initial line width control systems may include a print head for depositing radiation curable gel ink onto a substrate to form an as-deposited ink line; and a substrate heating system for heating the substrate and the ink to control or increase an initial width of the ink line. Systems may include a curing system for irradiating the ink of the ink line having the increased line width to partially cure the ink. The curing system may include a radiation source such as a UV source.

In an embodiment, systems may include a substrate heating system controller, the controller being configured to heat the substrate to a predetermined temperature, the controller being in communication with a memory module, the predetermined temperature being stored on the memory module corresponding to substrate type. Systems may include a curing system controller being configured to apply a predetermined amount of radiation to the ink to partially cure the ink, the predetermined amount of radiation being stored on a memory module corresponding to substrate type.

Exemplary embodiments are described herein. It is envisioned, however, that any systems that incorporate features of methods, apparatus, and systems described herein are encompassed by the scope and spirit of the exemplary embodiments.

DETAILED DESCRIPTION

Figure 1:
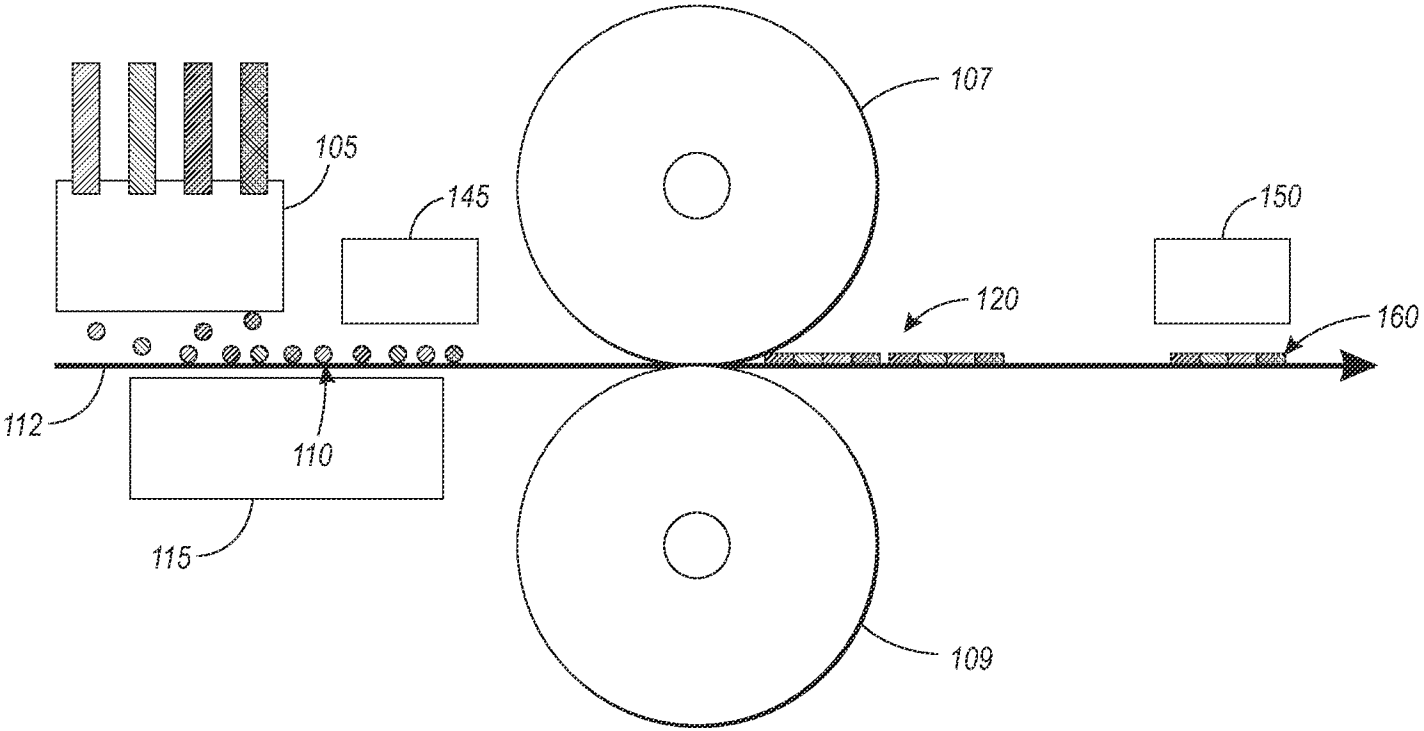
FIG. 1 shows a diagrammatical side view of a radiation curable gel ink initial line width control and leveling apparatus, and direct-to-substrate printing system in accordance with an exemplary embodiment.

Exemplary embodiments are intended to cover all alternatives, modifications, and equivalents as may be included within the spirit and scope of the methods, apparatus, and systems as described herein.

Reference is made to the drawings to accommodate understanding of methods, apparatus, and systems for radiation curable gel ink leveling. In the drawings, like reference numerals are used throughout to designate similar or identical elements. The drawings depict various embodiments and data related to embodiments of illustrative methods, apparatus, and systems for spreading radiation curable gel ink deposited directly onto a substrate such as a cut sheet or media web. The as-jetted ink, which may be deposited to form an ink line(s), may be heated to spread the ink before contacting the ink at a contact-leveling nip. Methods include controlling an initial line width of the ink to spread the ink for enhanced contact leveling and/or gloss control while minimizing or avoiding showthrough and/or coalescence of the ink.

FIG. 1 shows a radiation curable gel ink printing system and leveling apparatus in accordance with an exemplary embodiment. Specifically, FIG. 1 shows a radiation curable gel ink printing system having a print head 105 for jetting radiation curable gel ink. The print head 105 may be configured to contain and/or deposit or jet one or more inks, which may be black, clear, magenta, cyan, yellow or any other desired ink color.

The gel ink may be any radiation curable ink. For example, the gel ink may be curable by UV radiation. Further, the gel ink may be deposited by means other than an ink jet print head. The ink may be deposited directly onto the substrate by any suitable ink deposition means. For example, the ink may be jetted by ink jet print head 105 as shown in FIG. 1, or may be deposited by systems such as microelectromechanical systems configured to deposit gel ink onto a substrate, including gel ink that is heated to a liquid state.

The radiation curable gel ink printing system may include a leveling apparatus having a leveling nip formed by a contact member 107 and a pressure member 109. The print head 105 may be configured, e.g., to jet or deposit UV gel ink directly onto a substrate to form an as-jetted image 110. For example, print head 105 may jet ink onto a substrate. The cut sheet may be a paper cut sheet, for example. Alternatively, the substrate may be a paper web such as web 112 as shown in FIG. 1.

The gel ink deposited on the web 112 for forming as-jetted image 110, which may comprise as-jetted ink in the form of ink lines, may be heated. For example, a substrate heating system 115 may be arranged adjacent to a substrate. The heating system may be arranged adjacent to an ink deposit zone at which ink contacts the substrate after being released from the print head 105. The heating system 115 may be configured to heat the substrate by radiation, conduction, convection, or other suitable methods. For example, the blowers may be configured to heat the substrate for heating the as-jetted ink on the substrate. As the ink is heated, the ink may spread, and a width of an ink line formed by the ink may be increased.

After UV gel ink has been jetted onto the web 112, and heated and spread by the substrate heating system 115, the web may be translated in a process direction to a leveling apparatus. The leveling apparatus may include a contact-leveling nip defined by a contact member 107 and a pressure member 109. As shown in FIG. 1, the contact member 107 may be a drum or roll that is rotatable about a central longitudinal axis. The contact member 107 may include a contact surface, which may be configured to contact jetted ink on an ink bearing surface of the substrate 112. In an alternative embodiment, the contact member may be a belt having a contact surface.

The contact member 107 may be associated with the pressure member 109 to define a leveling nip therewith for roll-on-roll leveling. The surface of the pressure member 109 may be elastomeric and suitable for forming a nip with the contact member 107. The contact member 107 may be formed of metal, ceramic, or other suitable material. The pressure member 109 may be a rotatable roll as shown. In an alternative embodiment, the pressure member may be a belt such as an endless belt.

The web 112 may be configured to carry the spread gel ink through the nip to level the gel ink on the web 112. The contact member 107 levels the ink by applying pressure to the ink on the substrate to produce a leveled ink image 120. A final image quality and/or gloss may be enhanced by contact-leveling ink that has been spread and flattened by heating the substrate with heating system 115. Accordingly, the contact member 107 contacts ink that has been heated and spread by the heating system 115.

In an embodiment, the leveling nip may be associated with a radiation source such as a UV source. As shown in FIG. 1, the UV gel ink printing system may include a UV source 145. The UV source 145 may be arranged to apply UV radiation to the spread ink before the ink is leveled by the contact member 107 and the pressure member 109 of the leveling nip.

The UV source 145 may be configured to cure the ink such that an amount of the ink polymerizes. For example, a small of amount of ink comprising the ink image 110 may be polymerized. A second radiation source may be positioned downstream of the leveling nip and may be adapted to irradiate a contact-leveled gel ink image produce a final cured image.

Preferably, the radiation source 145 may be configured to apply radiation to the deposited, heated and spread gel ink to polymerize enough of the gel ink to increase a viscosity of the ink before the ink is contacted by the contact member 107. For example, the viscosity of the ink may be altered, e.g. increased, to minimize or eliminate offset of the radiation curable gel ink to the contact member 107 during leveling and/or contact of the ink by the contact member 107 at the leveling nip. The amount of cure required to minimize or prevent offset may depend on ink properties, including, for example, amount of gel, monomer composition, and an amount of photoinitiator present. Further, an amount of cure to apply may depend on radiation wavelength and interaction with the photoinitiator, and exposure, including a combination of wavelength, intensity, and time.

In an embodiment, the UV source 145 may be a first UV source, and a UV curable gel ink digital printing system may include a second UV source 150. The second UV source 150 may be configured to apply UV radiation after the ink of the image 110 is leveled by the contact member 107 to produce the leveled ink image 120. As shown in FIG. 1, the UV source 150 may be used to irradiate the leveled ink image 120 to produce a final cured ink image 160. In other embodiments, a radiation source may be configured to irradiate and cure radiation curable inks by means other than UV radiation. For example, e-beam systems may be used.

The contact member 107 may be a leveling roll that is configured to apply pressure to the spread ink to produce a leveled and/or gloss controlled ink image 120. For example, the contact member 107 may be a leveling roll configured to rotate about a central longitudinal axis. Before the contact member 107 contacts the spread ink, a viscosity of the ink may be altered by the UV source 145. For example, the ink may be thickened to, e.g., minimize or prevent offset of the ink to the contact member 107 during leveling. The ink may be thickened as desired by applying an amount of cure required to minimize or prevent offset. The amount of cure applied may depend on ink properties, including, for example, amount of gel, monomer composition, and an amount of photoinitiator present. Further, an amount of cure to apply may depend on radiation wavelength and interaction with the photoinitiator, and exposure, including a combination of wavelength, intensity, and time.

The contact member 107 is configured with pressure member 109 to form a leveling nip. The contact member 107 may be a roll having a ceramic surface that contacts the opposing pressure member, e.g., a roll having an elastomeric surface, to form a nip. For example, the contact surface of the contact member 107 may comprise metal oxide. In an embodiment, the contact member 107 may comprise titanium dioxide or titania. In another embodiment, the contact surface of the contact member 107 may comprise chromium oxide. A hydrophilic contact surface comprising metal oxides such as chromium oxide, and preferably, titanium dioxide may accommodate absorption of water-based release fluids, which further accommodates effective leveling of the UV gel ink by minimizing or preventing offset of gel ink from the substrate 112 to the contact member 107. The pressure member 109 may comprise a hydrophobic surface.

Release fluid may be added to a surface of the contact member 107 before the contact surface contacts a jetted ink image 110 for leveling. For example, a sacrificial release layer fluid may be contained and/or deposited onto a contact member 107 by a leveling apparatus release fluid system (not shown). The release fluid system may be configured to contain and/or deposit release fluid onto a surface of the contact member 107. Exemplary release fluids that may be effectively used with, e.g., a titanium dioxide ceramic surface include sodium dodecyl sulfate (SDS) based fountain solutions, and preferably polymer based fountain solution such as SILGAURD. Release fluids may include water-soluble short chain silicones, water with surfactants, defoamers, and other fluids suitable for forming a sacrificial release layer.

While irradiating as-deposited gel ink on a substrate before contact-leveling the gel ink may accommodate contacting the gel ink at a leveling nip with minimal offset of the ink onto leveling members at the nip, image quality and gloss control may be enhanced by spreading as-deposited ink lines on the substrate before contacting the ink at the leveling nip. An amount of line spread, or a target line width may be depend on a difference between a surface energy of the substrate and the ink, and the temperature of substrate. For example, a target line width may depend on a quenching rate to a gel state of a particular ink on a substrate type.

A determination of a line width that is effective for enhancing image quality and/or controlling gloss should balance consideration for the deleterious effects that may be associated with heating the substrate having the as-deposited ink and/or ink lines thereon. For example, for porous media, if the media or substrate is heated, the gel ink may showthrough as the ink soaks into the substrate. Further, if the ink becomes too hot, the ink may flow for too long, and the ink drops that form an ink line on the substrate may coalesce. Further, when the substrate is heated, an increased number of photons may be required for pre-contact-leveling thickening exposure. Accordingly, it is advantageous to increase an initial line width of the as-deposited gel ink by heating the substrate while avoiding showthrough and/or coalescence of the ink.

Figure 2:
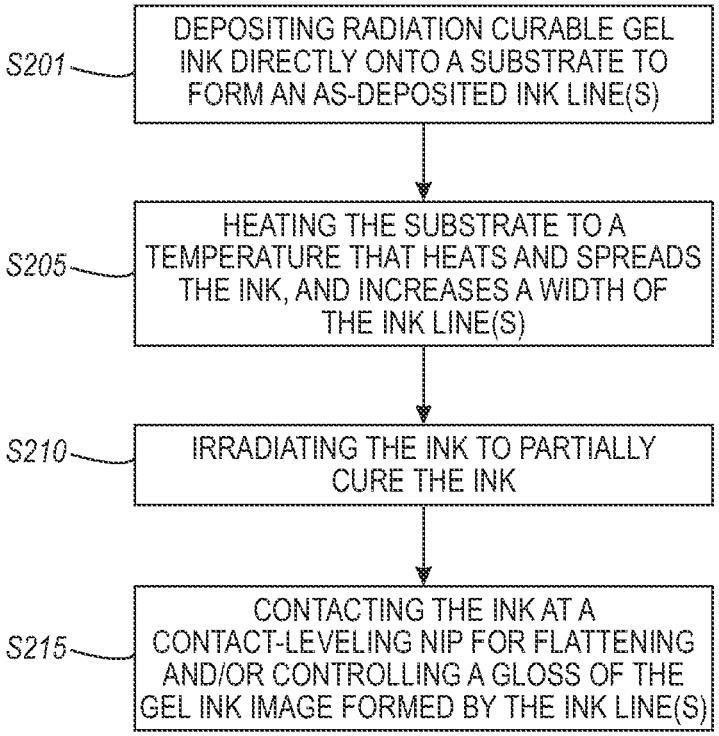
FIG. 2 shows radiation curable gel ink as-deposited ink spreading methods in accordance with an exemplary embodiment.

FIG. 2 shows radiation curable gel ink as-deposited ink spreading methods in accordance with an exemplary embodiment. At S201, radiation-curable gel ink may be deposited on a surface of a substrate such as a cut sheet or paper web. The ink may be deposited to form as-deposited ink lines. The gel ink may be deposited in the form of liquid drops that quench to a gel state upon contact with the substrate.

The gel ink of the as-deposited ink lines may be heated to soften and spread the ink at S205. As the ink spreads, a line width of an ink line formed by the as-deposited ink may increase, and a height, e.g., a pile height, of the ink line may be decrease.

The ink may be heated by heating the substrate on which the ink is deposited. For example, a heating system may heat the substrate using conduction or convection heating techniques. The heating system may comprise blowers for blowing hot air against the substrate to heat the substrate. Heat from the heated substrate transfers to the as-deposited ink on the substrate to heat the ink for spreading the ink. As-deposited ink that forms an ink line may be heated to increase an initial line width of the ink line. The substrate may be heated to a suitable temperature. For example, the substrate may be heated to a temperature that minimizes or avoids showthrough and/or coalescence of heated ink on the substrate.

After the as-deposited ink is heated and spread, the ink may be irradiated by a radiation source to thicken the ink. For example, at S210, after an initial line width of the ink forming the ink line is increased by heating the as-deposited ink, the ink may be irradiated by a radiation source. The radiation source may be a UV source. The radiation source may irradiate the ink to, e.g., partially cure the ink. Specifically, the radiation source may irradiate the ink to activate an amount of photoinitiators in the ink to partially cure the ink so that the ink is thickened to prevent offset of the ink at a contact-leveling nip.

The spread and irradiated ink may be contact-leveled at a leveling nip. The leveling nip may be defined by a contact member and a pressure member configured to apply pressure against the ink and the substrate to fix the ink to the substrate. For example, at S215, the as-deposited, spread ink line may be contact-leveled at a leveling nip to flatten the ink line. Contact-leveling the ink may accommodate control over a gloss level of the printed image formed by the ink on the substrate.

While it is advantageous to heat a substrate on which gel ink is deposited to cause the ink to spread and thereby, e.g., increase an initial line width an ink line(s) formed by the ink before contacting the ink at a leveling nip, it has been found that as particular substrates are heated, issues including showthrough and coalescence may arise. For example, as porous media such as rough paper is heated, the fibers tend to wick liquid ink, resulting in showthrough in the final print. Specifically, it has been found that the higher the temperature to which the substrate is heated, the more that the ink penetrates the substrate, and the more likely it is that the image formed by the ink is at least partially visible form a back side of the media after printing.

Ink penetration into a heated substrate may be less problematic for non-porous and coated media. Non-porous and coated media have been found, however, to cause coalescence of ink drops deposited thereon when heated. For example, as the temperature of the media increases, ink drops may have more time to coalesce with neighboring ink drops. Accordingly, it is advantageous to increase a temperature of a substrate on which gel ink is deposited to spread the ink and, e.g., increase a line width of the ink while minimizing or avoiding showthrough and/or coalescence.

It is further advantageous to implement methods for automatically setting a substrate temperature according to a substrate type on which a print operation is to be run. For example, a radiation curable gel ink initial line width control system may include a printing system as shown in FIG. 1 that is associated with one or more controllers for controlling at least one of a substrate heating system and a radiation source. The controller may be in communication with one or more memory modules for storing predetermined temperatures for particular substrate types, and/or predetermined amounts of radiation to apply for partial cure of particular ink color(s) on particular substrate type(s). A controller may be configured to execute computer readable instructions for determining or automatically learning an optimal temperature to which to heat a substrate of a particular type and thickness.

Figure 3A:
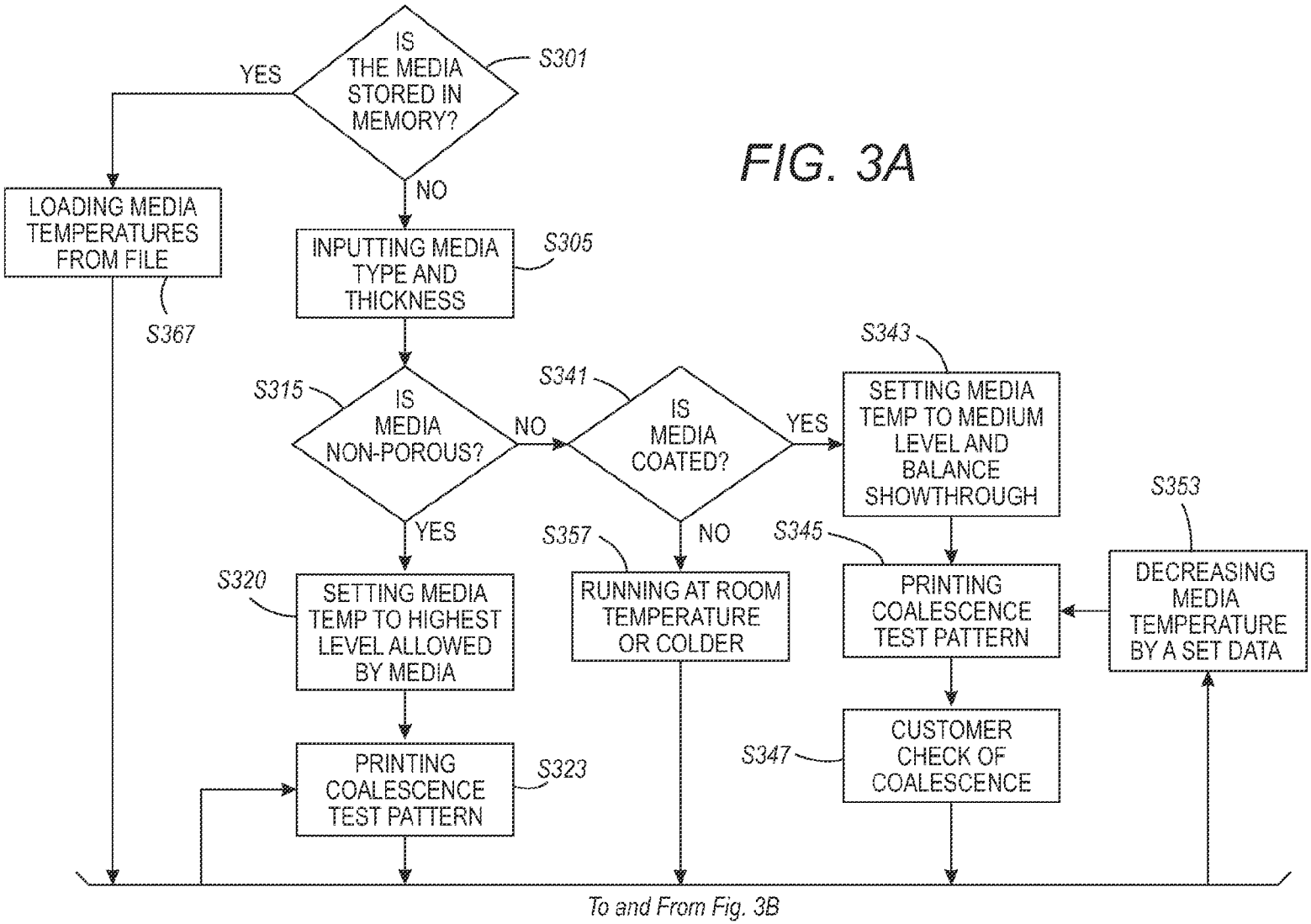
FIG. 3A shows radiation curable gel ink as-deposited line width control methods in accordance with an exemplary embodiment.
Figure 3B:
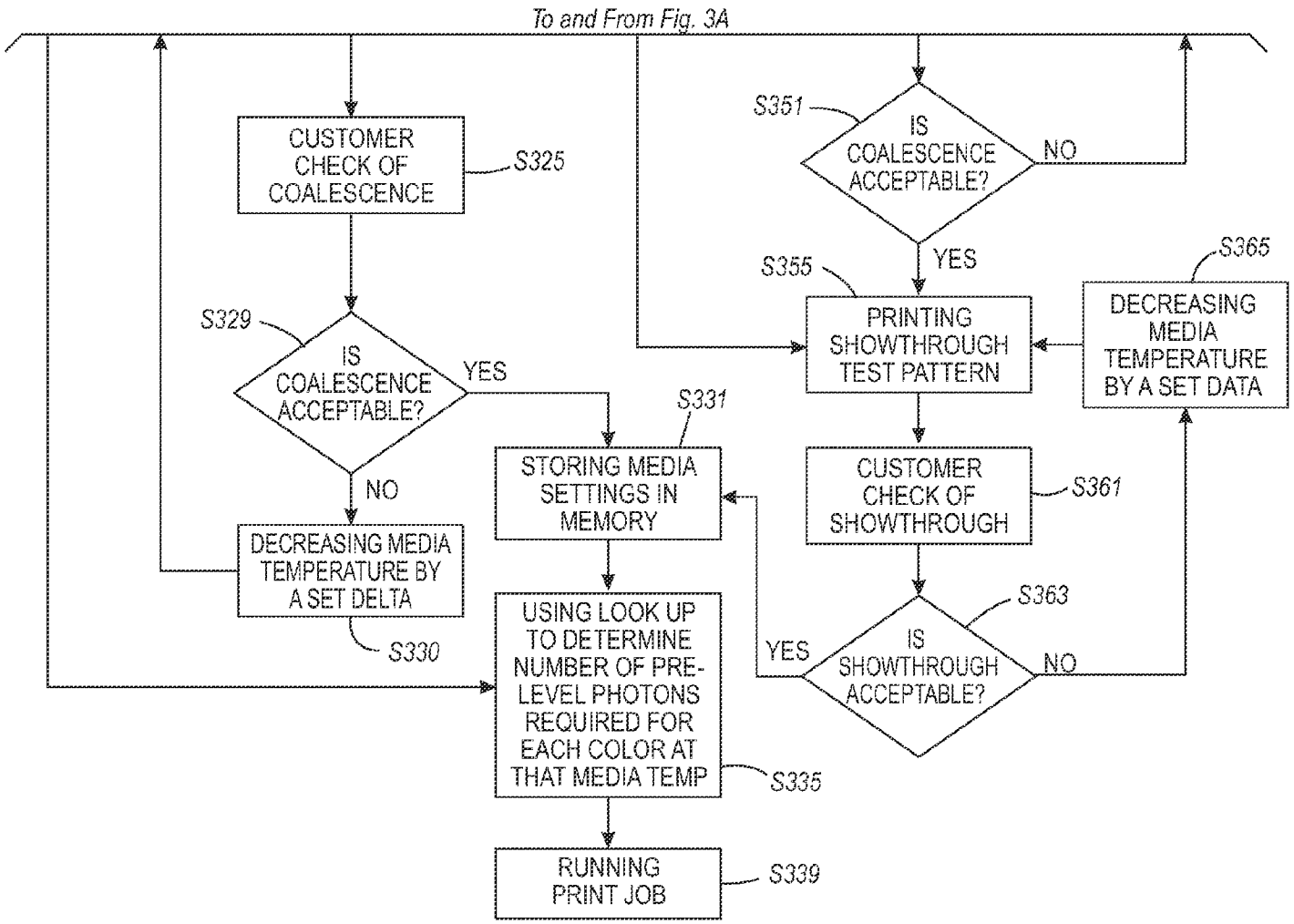
FIG. 3B shows radiation curable gel ink as-deposited line width control methods in accordance with the exemplary embodiment shown in FIG. 3A.

FIGS. 3A-3B shows radiation curable gel ink as-deposited spreading methods including media temperature control in accordance with an exemplary embodiment. Methods as shown in FIGS. 3A-3B may be implemented, for example, as computer-readable instructions recorded on a computer readable medium. The instructions may enable a machine to learn media and achieve an effective, e.g., an optimal, ink line width while minimizing or avoiding showthrough and/or coalescence.

As shown in FIG. 3A, methods may include determining whether media or substrate-related information for a particular substrate type is stored in memory at S301. Data relating to the particular substrate type may include a temperature at which ink deposited on the substrate spreads as desired. In particular, the temperature relating to the particular media type may be a temperature to which the substrate may be heated to spread as-deposited gel ink while minimizing or preventing showthrough and/or coalescence of the ink. Data may also include a number of photons required for each ink color at a particular media or substrate temperature to, e.g., partially cure the ink on the particular substrate type. The data may be arranged in the form of a look-up table.

A controller may be configured to query a memory storage module for determining whether a media file is stored in the memory module. The media file may include data relating to a substrate type on which radiation curable gel ink is to be deposited for a print operation.

If data related to the substrate type on which gel ink is to be deposited is not available and/or stored in memory, methods may include determining a temperature to which to heat the substrate to spread as-deposited gel ink or increase an initial line width of ink line(s) formed by the ink, while minimizing and/or avoiding showthrough and/or coalescence. For example, as shown in FIG. 3A, methods may include inputting a substrate type and thickness at S305. The media or substrate type and thickness may be input by an operator of the system, or by a sensor system configured to determine a substrate thickness and/or substrate type.

At S315, methods may include determining whether the media or substrate is non-porous. If the media is non-porous, methods may include setting a substrate temperature to a highest temperature allowed by the input substrate type at S320. For example, a highest effective temperature to which to heat the substrate may be predetermined, and may be stored in memory. The highest effective temperature may be a temperature below a temperature at which coalescence has previously been determined to be unacceptable by way of, e.g., printing and judging a coalescence test print such or test pattern.

Using the temperature set at S320, a test print operation or test pattern may be run at S323. As show in FIG. 3B, at S325, a customer may check the test print or pattern. For example, a customer may observe a physical copy of the test print or pattern. Alternatively, a customer may view test print(s) or test pattern(s) on a display. One or more test patterns may be stored in a memory module. For example, a plurality of test prints or patterns may be stored in memory, and may be presented to a user or customer by way of a display for observation and/or judging an effectiveness of the test print(s) run at particular temperature(s) set at S320.

At S329, a customer may determine whether coalescence is acceptable. For example, a customer may observe a physical test print or pattern to determine whether the substrate has been heated to a temperature that produces noticeable coalescence or unacceptable coalescence of ink drops on the substrate. Alternatively, a customer may view one or more test prints or test patterns on a display. Methods may include choosing which test print or test pattern is acceptable from a plurality of choices presented on a display. The displayed test print images may indicate whether coalescence resulted at a substrate temperature set for a particular substrate type. A customer may select a test print image by inputting a selection by a button, keyboard, touchscreen device, or suitable input device and/or system.

If coalescence for a test print run at a substrate temperature set at S320 is determined to be unacceptable at S329, then a media temperature may be decreased at S330 by a set delta. S323, S325, and S329 may be repeated to determine with coalescence is acceptable at the decreased temperature. S323, S325, S329, and S330 may be repeated as needed to find or learn a substrate or media temperature that produces a test image with acceptable coalescence. In an alternative embodiment, S325 and S329 may be carried out by a computer using an image analysis system for imaging the test print, determining an amount of coalescence present, and finding coalescence unacceptable using image analysis if present at or above a predetermined threshold.

If coalescence of a test print or pattern is determined to be acceptable at S329. The substrate temperature set at S320 may be stored in a memory module. The temperature may be stored in association with the media type input at S305. For example, at S331, the set temperature determined to produce acceptable spreading of ink may be stored electronically in a file corresponding to the substrate type input at S305. The file may be stored in a memory module associated with a radiation curable gel ink printing apparatus and/or system.

At S335, the system may query a look-up table stored in a memory module to determine an amount of radiation to apply to the spread ink to avoid offset of the ink onto components of the contact-leveling system. For example, a look-up table may be used to determine a number of photons required for partially curing the ink spread on the substrate, which has been heated to the temperature set at S320. The look-up table, or an alternative similarly accessible data arrangement, may be used to determine a number of photons required for each color of ink at the substrate temperature set at S320. Using the data stored in S331, and determined in S335, a print job may be run for the substrate type that was input in S305 as shown in FIG. 3A.

If a preferred temperature for a particular substrate type was predetermined and stored in a memory module, a print operation for the substrate type may determine at S301 as shown in FIG. 3A that a file related to the media or substrate type is stored in memory. The file may be loaded at S367 for setting a substrate temperature, and the print job for the particular substrate type may be run at the loaded temperature at S339 as shown in FIG. 3B. Further, the amount of radiation determined at S335 may be loaded and set for running the print job at S339.

If the substrate type or media input at S305 is determined to be non-porous at S315, as shown in FIG. 3A, methods may include determining whether the media is coated at S341. If the media is determined to be coated at S341, then a substrate or media temperature may be set to a nominal temperature at S343. For example, the nominal temperature may be a predetermined estimated temperature intended to approximate a balance between showthrough and effective spreading of as-deposited gel ink. Using the nominal temperature set at S343, a test coalescence print or pattern may be run at S345.

At S347, a customer may check whether coalescence is acceptable. For example, a customer may observe a physical coalescence test print or pattern to determine whether the substrate has been heated to a temperature that produces noticeable coalescence or unacceptable coalescence of ink drops on the substrate. Alternatively, a customer may view one or more test prints or test patterns as images on a display. Methods may include choosing which test print or test pattern is acceptable from a plurality of image choices presented on the display. The displayed test print images may indicate whether coalescence resulted at a substrate temperature set for a particular substrate type. A customer may select a test print image by inputting a selection by a button, keyboard, touchscreen device, or other suitable input device and/or system.

If coalescence for a test print run at a substrate temperature set at S343 is determined to be unacceptable at S351 as shown in FIG. 3B, methods may include descreasing the temperature set at S343 by a predetermined delta at S353 as shown in FIG. 3A. Using the temperature set at S353, S345, S347, S351, and S353 may be to determine whether the adjusted temperature set as S353 results in acceptable coalescence. S353, S345, S347, and S351 may be repeated as needed to find a substrate temperature that produces a test image coalescence that is determined to be acceptable at S351.

If coalescence of a test print or pattern is determined to be acceptable at S351 as shown in FIG. 3B, methods may include printing at S355 a showthrough test pattern on the coated media at the substrate temperature found to be acceptable at S351. Alternatively, if the media or substrate is determined to be uncoated at S341, a media or substrate temperature may be set at room temperature or below at S357. The temperature set at S357 may be used to run a showthrough test print or pattern at S355.

A customer may check the test pattern or print at S361 for showthrough. Showthrough may be checked by visual analysis. For example, a user may check showthrough by inspecting a physical copy of the test print. Alternatively, test prints may be imaged and displayed to a user for inspection and selection. In an alternative embodiment, methods may include checking showthrough by way of image analysis processing carried about by an image analysis system or sensor system. If showthrough is found to be unacceptable at S363, methods may include decreasing a substrate temperature by a predetermined delta at S365, and printing a test print or pattern at S355 using the decreased temperature set at S365. S355, S361, S363, and S365 and may repeated as needed to find a substrate or media temperature at which showthrough is acceptable. If showthrough is found to be acceptable at S363, then the temperature at which showthrough was determined to be acceptable may be stored in a memory module. For example, the temperature may be stored and associated with the substrate type input at S305 as shown in FIG. 3A.

The substrate temperature set at S320, S343, and/or S365 may be stored in a memory module. The temperature may be stored in association with the media type input at S305. For example, the set temperature determined to spread ink with acceptable showthrough and/or coalescence may be stored electronically in a file corresponding to the substrate type input at S305. The file may be stored in a memory module associated with a radiation curable gel ink printing apparatus and/or system.

While methods, apparatus, and systems for controlling an initial line width of as-deposited radiation curable gel ink are described in relationship to exemplary embodiments, many alternatives, modifications, and variations would be apparent to those skilled in the art. Accordingly, embodiments of methods, apparatus, and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A radiation curable gel ink spreading method, comprising:

heating radiation curable gel ink deposited on a substrate before contact-leveling the ink at a leveling nip;

heating the substrate to a predetermined temperature using a substrate heating system;

determining whether a substrate file corresponding to the substrate is stored in a memory module, the substrate file including the predetermined temperature that corresponds to the substrate type;

if the substrate file is stored in the memory module, inputting the predetermined temperature corresponding to the substrate type to a controller, the controller being in communication with the substrate heating system, to heat the substrate to the predetermined temperature;

if the substrate file is not stored in the memory module, inputting a substrate type;

inputting a substrate thickness;

if the substrate is porous, determining whether the substrate is coated;

if the substrate is porous and coated, setting a substrate temperature to a predetermined test temperature;

printing a coalescence test pattern wherein the substrate is heated to the set substrate temperature;

determining whether a coalescence of the test pattern is acceptable;

if the coalescence is acceptable, printing a showthrough test pattern at the set substrate temperature;

determining whether showthrough of the test pattern is acceptable;

if showthrough is acceptable, storing the set temperature as a predetermined temperature in a substrate file;

if showthrough is not acceptable, decreasing the set substrate temperature by a predetermined amount.

2. The method of claim 1, comprising:

depositing the radiation curable gel ink onto the substrate to form an as-deposited ink line, wherein the heating increases a width of the as-deposited ink line.

3. The method of claim 1, comprising:

irradiating the ink to partially cure the ink.

4. The method of claim 1, comprising:

contact-leveling the ink on the substrate with a contact member at a leveling nip, the leveling nip being formed by the contact member and a pressure member.

5. The method of claim 1, the heating comprising:

heating the substrate.

6. The method of claim 1, the substrate file including a look-up table configured for determining an amount radiation required for each color of the ink at the predetermined temperature to partially cure the ink, comprising:

inputting the amount of radiation required determined from the substrate file to a controller, the controller being in communication with a radiation source; and irradiating the ink to partially cure the ink, the irradiating being based on the determined amount of radiation input to the controller.

7. The method of claim 1, comprising:

if the substrate file is not stored in the memory module, inputting a substrate type;

inputting a substrate thickness;

if the substrate is non-porous, setting a substrate test temperature to a highest temperature available for the input substrate type having the input thickness;

printing a test pattern;

determining whether coalescence is acceptable; and if coalescence is acceptable, storing the substrate test temperature as the predetermined temperature in a substrate file.

8. The method of claim 1, comprising:

if the substrate file is not stored in the memory module, inputting a substrate type;

inputting a substrate thickness;

if the substrate is porous, determining whether the substrate is coated;

if substrate is porous and uncoated, setting a substrate temperature at about or less than ambient temperature, and printing a test pattern;

determining whether showthrough of the test pattern is acceptable;

if showthrough is acceptable, storing the set temperature as a predetermined temperature in a substrate file;

if showthrough is not acceptable, decreasing the set substrate temperature by a predetermined amount.

* * * * *